US007772959B2

(12) United States Patent
Cheng et al.

(10) Patent No.: US 7,772,959 B2
(45) Date of Patent: Aug. 10, 2010

(54) FUSE SEAT HAVING LIGHT-EMITTING MODULE OF HIDDEN TYPE

(76) Inventors: Wen-Tsung Cheng, No. 78 Chao-Chou St., Taoyuan (TW); Wen-Ho Cheng, No. 78 Chao-Chou St., Taoyuan (TW)

( * ) Notice: Subject to any disclaimer, the term of this patent is extended or adjusted under 35 U.S.C. 154(b) by 133 days.

(21) Appl. No.: 12/186,660

(22) Filed: Aug. 6, 2008

(65) Prior Publication Data

US 2010/0033292 A1 Feb. 11, 2010

(51) Int. Cl.
*H01H 85/32* (2006.01)
*H01H 85/30* (2006.01)

(52) U.S. Cl. ..... 337/242; 337/241; 337/265; 337/266

(58) Field of Classification Search ..... 337/241, 337/266, 242, 265
See application file for complete search history.

(56) References Cited

U.S. PATENT DOCUMENTS 3,588,775 A * 6/1971 Poehlman, Jr. ..... 337/226
4,281,322 A * 7/1981 Nasu et al. ..... 340/638
4,308,516 A * 12/1981 Shimada et al. ..... 337/241
4,391,485 A * 7/1983 Urani ..... 439/687
4,475,283 A * 10/1984 Olson et al. ..... 29/720
4,499,447 A * 2/1985 Greenberg ..... 337/266
4,661,807 A * 4/1987 Panaro ..... 340/638
4,941,851 A * 7/1990 Hsueh ..... 439/620.34
4,997,394 A * 3/1991 Katz et al. ..... 439/620.33
5,002,505 A * 3/1991 Jones et al. ..... 439/620.29
5,055,071 A * 10/1991 Carlson et al. ..... 439/620.34
5,311,139 A * 5/1994 Fogal ..... 324/550
5,701,118 A * 12/1997 Hull et al. ..... 340/638
5,874,884 A * 2/1999 Hull et al. ..... 337/241
6,054,915 A * 4/2000 Rowton et al. ..... 337/216
6,144,284 A * 11/2000 Santa Cruz et al. ..... 337/242
6,157,287 A * 12/2000 Douglass et al. ..... 337/198
6,373,370 B1 * 4/2002 Darr et al. ..... 337/243
6,448,897 B1 * 9/2002 Ku ..... 340/638
6,542,061 B2 * 4/2003 Santa Cruz et al. ..... 337/79
6,587,028 B2 * 7/2003 Mollet et al. ..... 337/194
6,775,148 B2 * 8/2004 Hong ..... 361/752
7,049,973 B2 * 5/2006 Torrez et al. ..... 340/638
7,385,518 B2 * 6/2008 Torrez et al. ..... 340/638
7,394,343 B2 * 7/2008 Cheng et al. ..... 337/265
2003/0179070 A1 * 9/2003 Izumi ..... 337/255
2004/0017203 A1 * 1/2004 Becker et al. ..... 324/507
2007/0109090 A1 * 5/2007 Cheng et al. ..... 337/123
2010/0019878 A1 * 1/2010 Darr et al. ..... 337/198

* cited by examiner

*Primary Examiner*—Anatoly Vortman
(74) *Attorney, Agent, or Firm*—Chun-Ming Shih; HDLS IPR Services

(57) ABSTRACT

A fuse seat having light-emitting module includes an insulating body, two electricity-conducting pieces and a light-emitting module. The insulating body is arranged with an accommodating space, in which two electricity-conducting pieces are fixed respectively. A fuse is plugged into the accommodating space and connected conductively to the electricity-conducting pieces. The light-emitting module is hidden in the insulating body and is connected electrically to the electricity-conducting pieces, thus a cost-saving effect is thereby achieved.

9 Claims, 6 Drawing Sheets

FUSE SEAT HAVING LIGHT-EMITTING MODULE OF HIDDEN TYPE

BACKGROUND OF THE INVENTION

1. Field of the Invention

The present invention generally relates to a fuse seat, in particular, to a fuse seat having a light-emitting module.

2. Description of Prior Art

Comprehensively, a general fuse is used in an electric product. When current passing through the electric product exceeds a load endurable by the fuse, the fuse will be fused and broken off to prevent circuit board or electronic component in the electric product from damage. Therefore, any electric product, for example, used in a power switch or a vehicle, is provided with a protection function, when equipped with this kind of protective device.

According to prior arts, a fuse device used in vehicle mainly includes a fuse seat, two electricity-conducting pieces and a fuse. The fuse seat is arranged with an accommodating space and two fixing troughs formed to the accommodating space. Two electricity-conducting pieces are fixed in two fixing troughs respectively. Two sides of each electricity-conducting piece are wound into an inserting trough, and the fuse is inserted into two inserting troughs. The fuse includes a shell and a light-emitting module arranged and embedded fixedly in the shell.

Under normal using condition, when current passes through the fuse, the light-emitting module won't emit light. However, when the fuse is broken off due to overload, current will pass through the light-emitting module instead, making an emission of light for indicating that this fuse has been burned down.

Nonetheless, this kind of fuse still has many drawbacks during practical use. For example, since the light-emitting module is embedded and accommodated fixedly in the shell of the fuse seat, the light-emitting module has to be discarded together with the burned down fuse that is already useless. In terms of product cost, discarding undamaged light-emitting module is a waste.

SUMMARY OF THE INVENTION

The invention is mainly to provide a fuse seat having a light-emitting module. Through hiding the light-emitting module in an accommodating space in an insulating body instead in the fuse itself, when the fuse is burned down, the light-emitting module is unnecessarily thrown away with the useless fuse, thus an effect of cost saving is achieved.

Therefore, the invention is to provide a fuse seat having a light-emitting module and a fuse is plugged therein conductively. The fuse seat includes an insulating body, two electricity-conducting pieces and a light-emitting module. The insulating body is arranged with an accommodating space, in which two electricity-conducting pieces are respectively fixed. The fuse is plugged into the accommodating space and connected conductively to the electricity-conducting pieces. The light-emitting module is hidden in the insulating body and is connected electrically to the electricity-conducting pieces.

BRIEF DESCRIPTION OF DRAWING

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE INVENTION

In cooperation with attached drawings, the technical contents and detailed description of the present invention are described thereinafter according to a number of preferable embodiments, being not used to limit its executing scope. Any equivalent variation and modification made according to appended claims is all covered by the claims claimed by the present invention.

Figure 1:
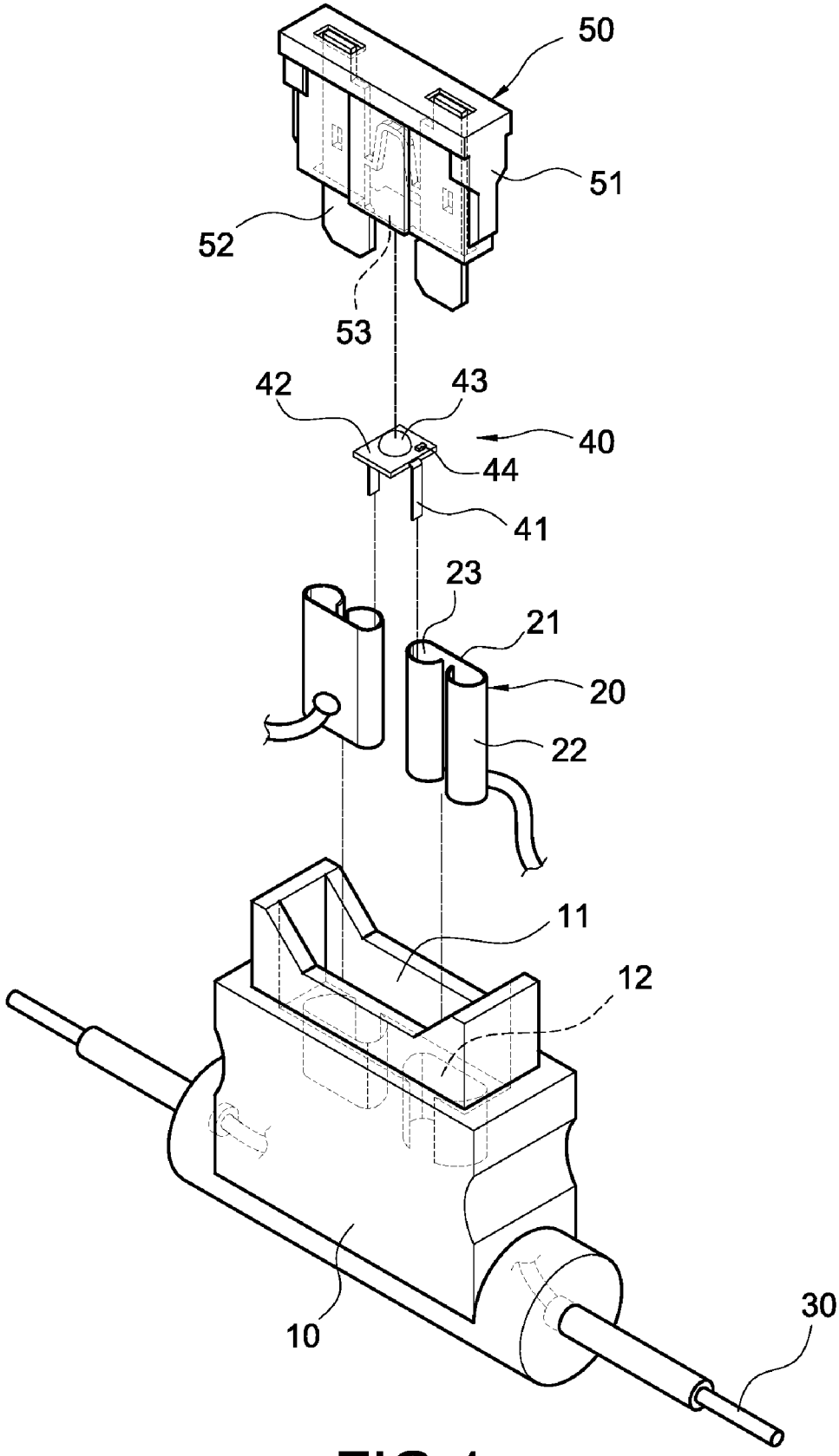
FIG. 1 is a perspective explosive view of the present invention.
Figure 2:
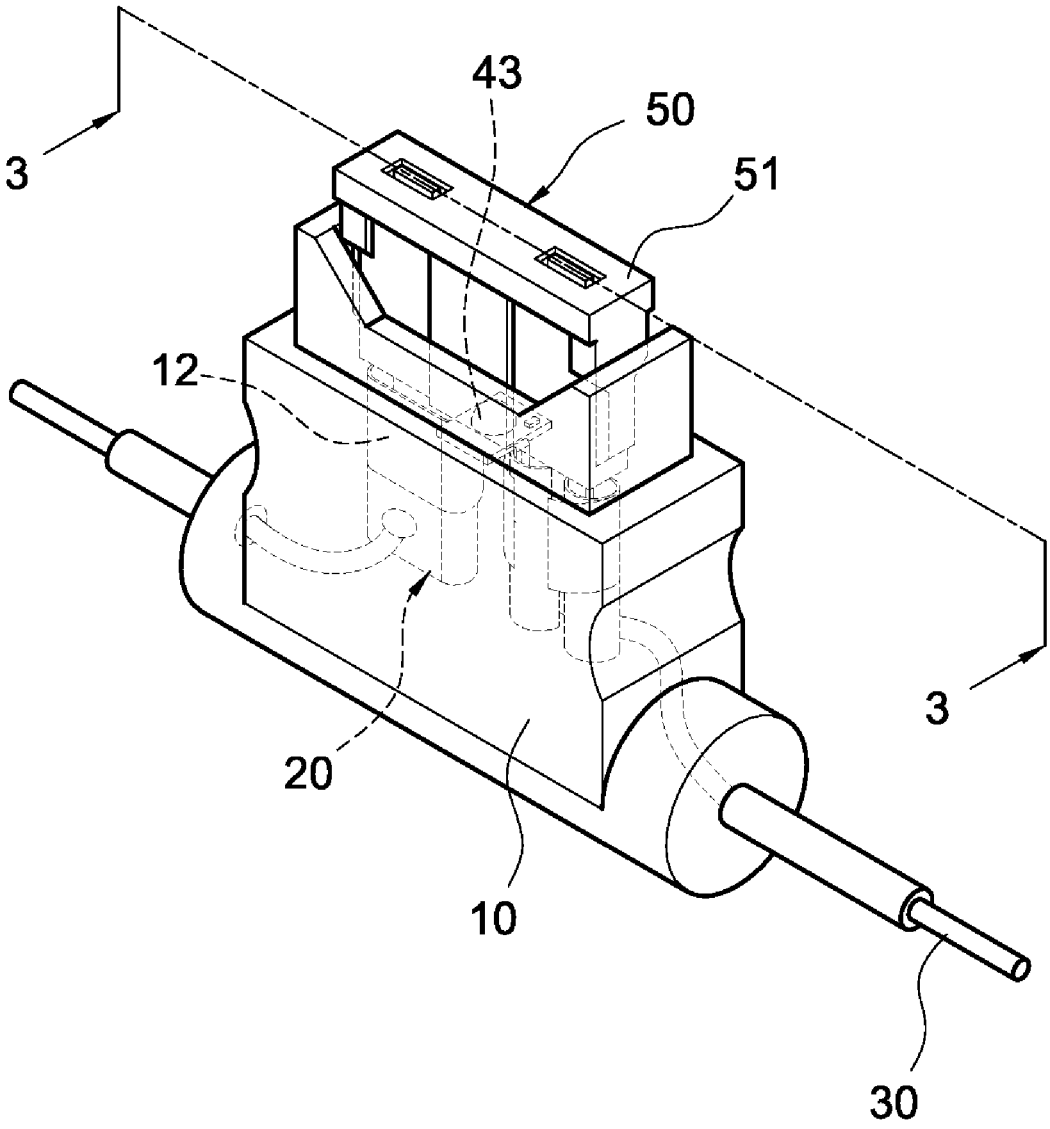
FIG. 2 is a perspective assembled illustration of the present invention.
Figure 3:
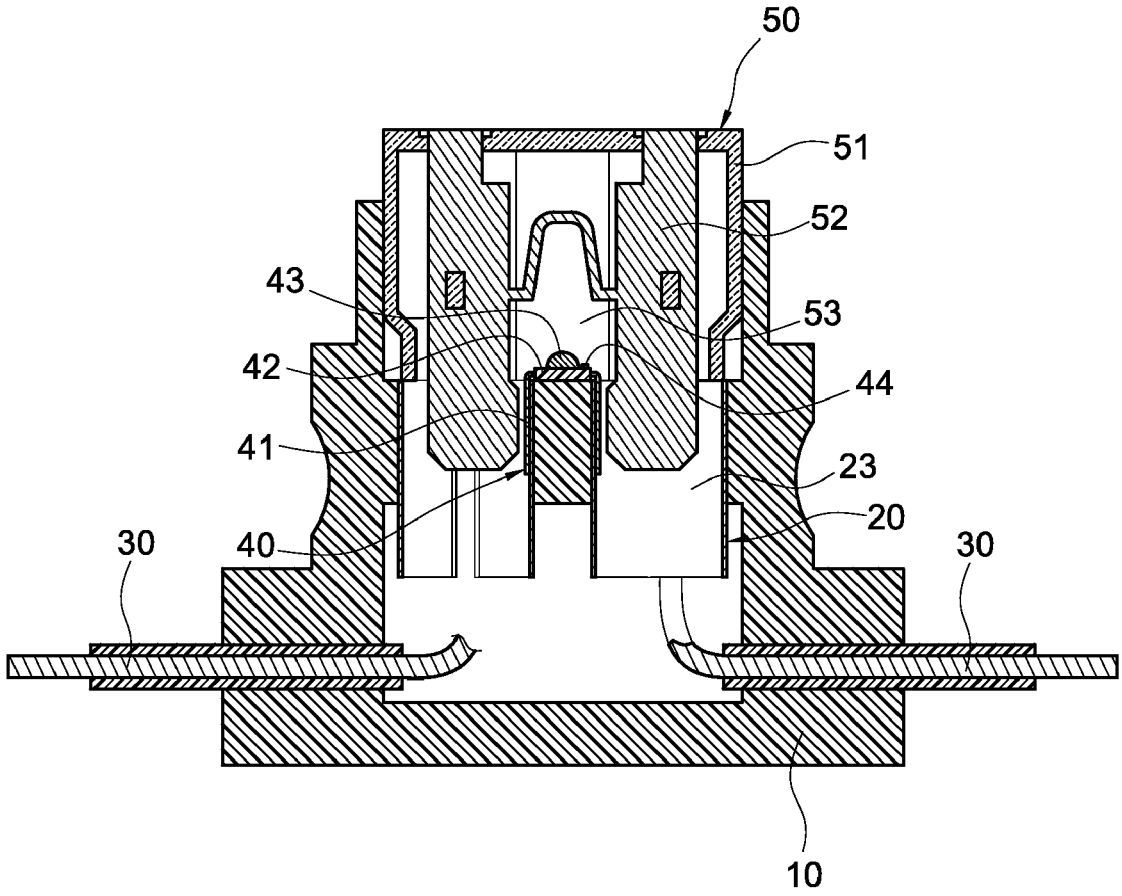
FIG. 3 is a cross-sectional illustration viewed from a 3-3 sectional plane in FIG. 2.

Please refer to FIG. 1 through FIG. 3. The present invention is related to a fuse seat having light-emitting module, provided for a fuse 50 plugged therein conductively, and including an insulating body 10, two electricity-conducting pieces 20, two electric wires 30 and a light-emitting module 40.

The insulating body 10 is arranged with an accommodating space 11 and two fixing troughs 12 communicating to the accommodating space 11. The accommodating space 11 is arranged on top of the insulating body 10 and is shown as a rectangular opening. Two fixing troughs 12 are respectively arranged in the insulating body 10, located under the accommodating space 11 and shown respectively as a substantial elliptical open trough.

Two electricity-conducting pieces 20 are arranged and fixed in two fixing troughs 12 respectively. The fuse 50 plugged in the accommodating space 11 is connected conductively to two electricity-conducting pieces 20. The electricity-conducting piece 20 includes an abutting connecting part 21 and two elastically clipping holding parts 22 extended from two sides of the abutting connecting part 21 and wound inward. An inserting trough 23 is formed between the elastically clipping holding part 22 and the abutting connecting part 21.

Two electric wires 30 are respectively connected to two electricity-conducting pieces 20 conductively and are extended out of the insulating body 10.

The light-emitting module 40 includes two conductively connecting legs 41 respectively connected to two electricity-conducting pieces 40 electrically, a circuit board 42 connected to two electricity-conducting pieces 20 electrically, an LED lamp 43 connected to the circuit board 42 electrically and a resistance 44 connected to the circuit board 42 electrically. The resistance 44 has a high resistance value, or the light-emitting module 40 is an LED having a high resistance value, which is hidden in the accommodating space and electrically connected to two electricity-conducting pieces 20. In this case, two conductively connecting legs 41 of the light-emitting module 40 are respectively plugged in two inserting troughs 23. When the light-emitting module 40 is damaged, two inserting troughs 23 are pulled out to replace another light-emitting module.

The fuse 50 includes a shell 51 and two metallic inserting pieces 52 accommodated in the shell 51. The shell 51 is made of material with superior transparence and is arranged with a positioning trough 53 at a central portion thereof. The positioning trough 53 is formed between two metallic inserting pieces 52 and is provided for the light-emitting module 40 to be positioned therein. Two metallic inserting pieces 52 are partially exposed out of the shell 51 and can be respectively inserted in two inserting troughs 23.

During assembling process of the invention, first, two conductively connecting legs 41 of the light-emitting module 40 are respectively inserted and elastically clipped and abutted in two inserting troughs 23, in the meantime, making the light-emitting module 40 fixed between two electricity-conducting pieces 20 and electrically connected thereto; finally, the fuse 50 is plugged into two inserting troughs 23 through two metallic inserting pieces 52 respectively, while the elastically clipping holding part 22 and the abutting connecting part 21 clip and abut the metallic inserting piece 52; thereby, the fuse 50 is fixed to the insulating body 10, while the light-emitting module 40 is positioned in the positioning trough 53.

When using the invention, first, two electric wires 30 are respectively connected to a power source, current passing through the fuse 50, instead of passing through the LED lamp 43 of the light-emitting module 40, so there is no light emitted from the LED lamp 43. When the fuse 50 is melted and broken off due to an occurrence of overload, current will pass through the LED lamp 43 instead and make a light emission. The light irradiates out of the shell 51 of the fuse 50 to indicate that the fuse 50 has already been burned down and is needed to be replaced. As soon as the fuse 50 is burned down, the fuse 50 cannot be used any more. However, when the useless fuse 50 is discarded, the undamaged light-emitting module 40 doesn't have to be thrown away together, thus an effect of cost saving is achieved.

Figure 4:
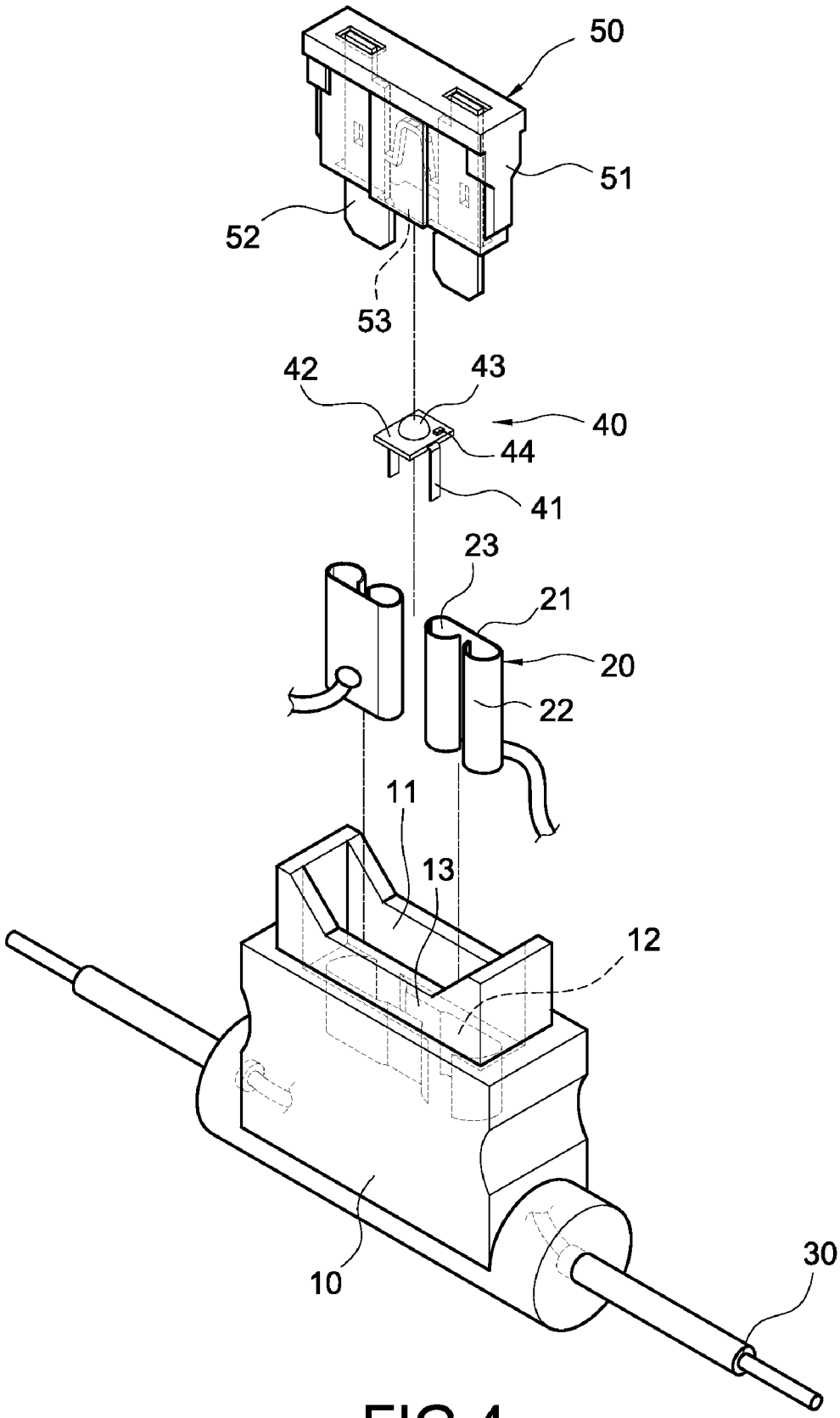
FIG. 4 is another embodiment of the present invention.
Figure 5:
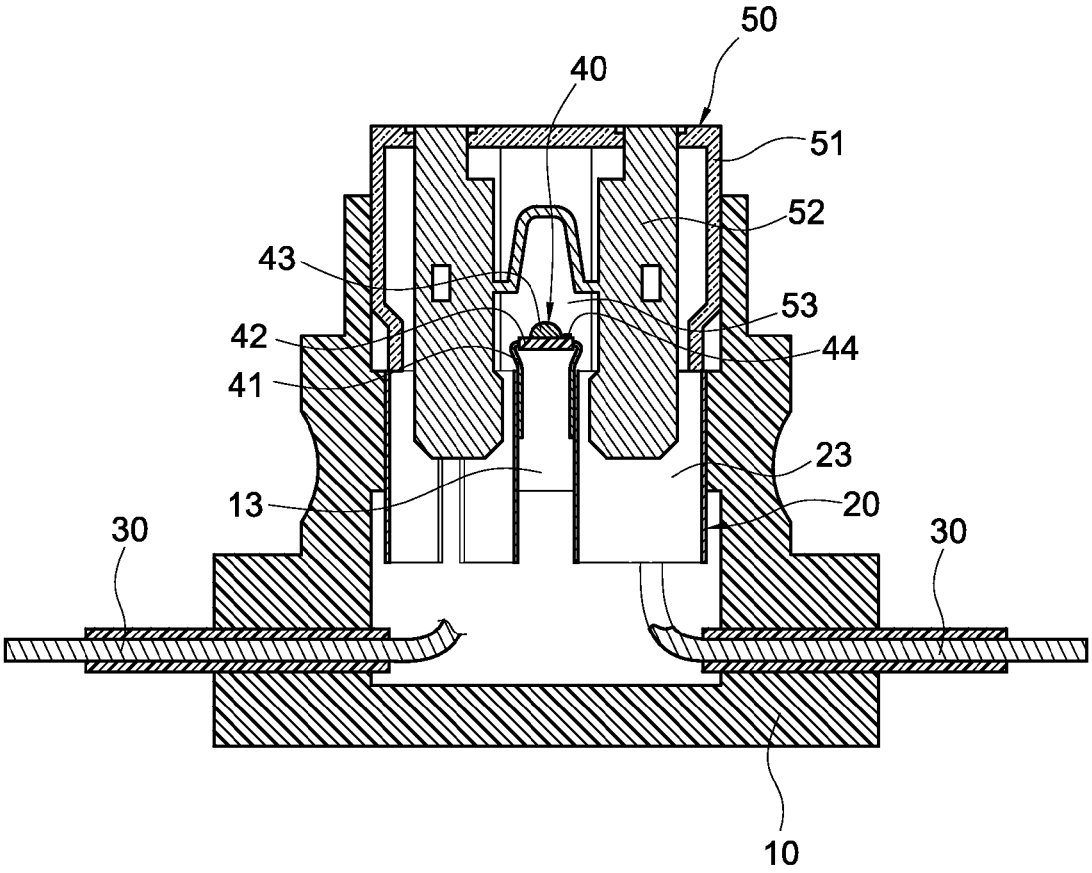
FIG. 5 is a cross-sectional view after the FIG. 4 is assembled.

Please refer to FIG. 4 showing another preferable embodiment according to the present invention, while FIG. 5 is a cross-sectional view of FIG. 4 after the embodiment has been assembled. The difference between the present embodiment and the previous one is that a trough path 13 positioned between two fixing troughs 12 is further arranged on the insulating body 10. In the meantime, two conductively connecting legs 41 of the light-emitting module 40 are respectively plugged inside the trough path 13 and are interconnected to two electricity-conducting pieces 20 conductively, thereby, the light-emitting module 40 being fixed between two electricity-conducting pieces 20 and constituting an electrical connection thereto.

Figure 6:
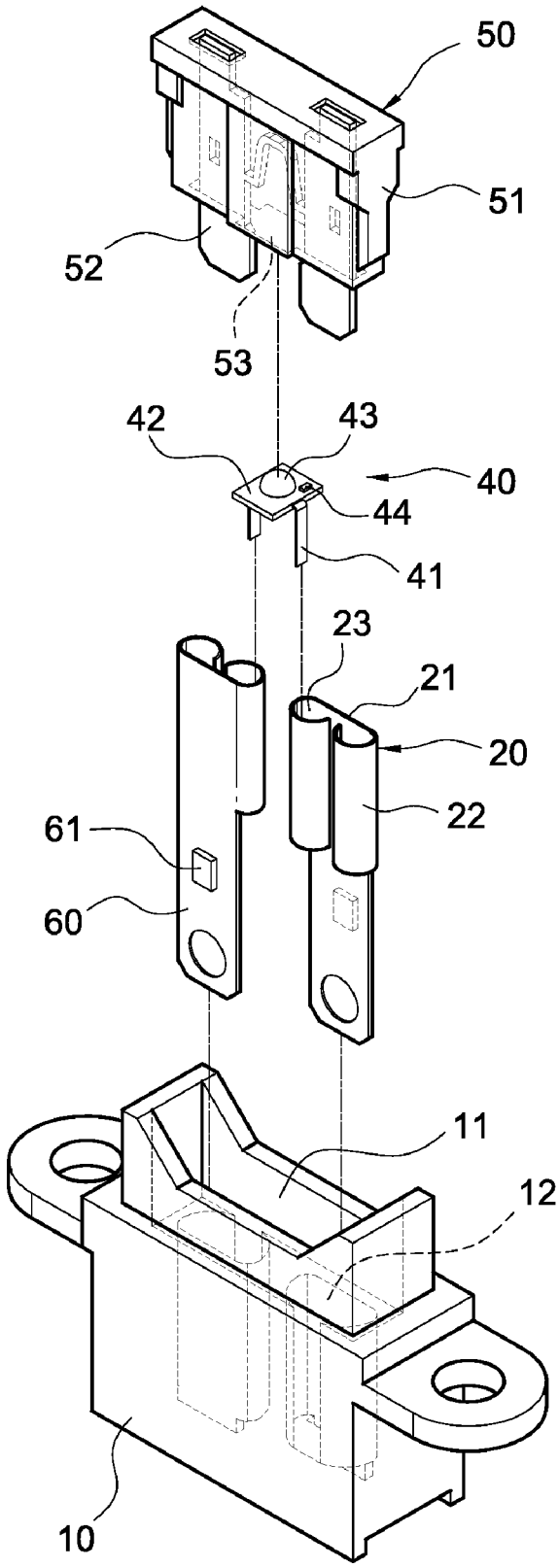
FIG. 6 is a further embodiment of the present invention.

Please refer to FIG. 6 showing a further embodiment of the invention. The difference between the present embodiment and previous one is that two inserting connecting pieces 60 may be in lieu of two electric wires 30. In this case, two inserting connecting pieces 60 are respectively extended out of the abutting connecting part 21 of the electricity-conducting piece 20, passing out of a bottom of the insulating body 10 and adopted to be plugged into an external socket (not shown in the figures). In the meantime, two hooking parts 61 are respectively projected out of the inserting connecting piece 60. The hooking parts 61 can be hooked in a bottom of the insulating body 10 for positioning the inserting connecting pieces 60 when passing through the bottom of the insulating body 10.

According to the aforementioned structure, a fuse seat having a light-emitting module of the present invention is thereby obtained.

Summarizing aforementioned description, the invention is an indispensably novel structure for a fuse seat indeed, which may positively reach the expected usage objective for solving the drawbacks of the prior arts, and which extremely possesses the innovation and progressiveness to completely fulfill the applying merits of new type patent, according to which the invention is thereby applied. Please examine the application carefully and grant it as a formal patent for protecting the rights of the inventor.

However, the aforementioned description is only a number of preferable embodiments according to the present invention, being not used to limit the patent scope of the invention, so equivalently structural variation made to the contents of the present invention, for example, description and drawings, is all covered by the claims claimed thereinafter.

What is claimed is:

1. A fuse seat having light-emitting module, including:

an insulating body, arranged with an accommodating space at top of the inside thereof and two fixing troughs being located under the accommodating space and inside the insulating body;

two electricity-conducting pieces, fixed in the two fixing troughs, respectively, a fuse having a shell, two metallic inserting pieces accommodated in the shell and partially exposed out of the shell, and a positioning trough accommodated inside the shell and formed between the two metallic inserting pieces, the fuse being plugged in the accommodating space and being connected conductively to the two electricity-conducting pieces by the two metallic inserting pieces; and a light-emitting module, sitting on and connected electrically to the two electricity-conducting pieces so that after the fuse is plugged in the accommodating space the light-emitting module is hidden in the positioning trough of the fuse.

2. The fuse seat having light-emitting module according to claim 1, wherein a trough path is formed between two fixing troughs, while the light-emitting module has two conductively connecting legs plugged in the trough path and respectively interconnected to the two electricity-conducting pieces conductively.

3. The fuse seat having light-emitting module according to claim 1, wherein the electricity-conducting piece includes an abutting connecting parts and two elastically clipping holding part extended from two sides of the abutting connecting part and wound inward, and wherein an inserting trough is formed between the elastically clipping holding part and the abutting connecting part, while the light-emitting module has two conductively connecting legs respectively plugged in the two inserting troughs.

4. The fuse seat having light-emitting module according to claim 3, wherein two inserting troughs are provided for the two metallic inserting pieces of the fuse conductively plugged in and connected to, respectively.

5. The fuse seat having light-emitting module according to claim 1, wherein the light-emitting module has two conductively connecting legs respectively connected to the two electricity-conducting pieces electrically, a circuit board connected to the two electricity-conducting pieces electrically, an LED lamp electrically connected to the circuit board and a resistance electrically connected to the circuit board.

6. The fuse seat having light-emitting module of hidden type according to claim 1, wherein the light-emitting module is an LED.

7. The fuse seat having light-emitting module according to claim 1, further including two electric wires respectively connected to the two electricity-conducting pieces electrically and passing through the insulating body.

8. The fuse seat having light-emitting module according to claim 1, further including two inserting connecting pieces respectively extended out of the two electricity-conducting pieces and passing through a bottom of the insulating body.

9. The fuse seat having light-emitting module according to claim 8, further including two hooking parts projected respectively out of the inserting connecting pieces to hook up the bottom of the insulating body.

* * * * *